US007011567B2

(12) United States Patent
Gerber

(10) Patent No.: US 7,011,567 B2
(45) Date of Patent: Mar. 14, 2006

(54) SEMICONDUCTOR WAFER GRINDER

(76) Inventor: Robert Gerber, 5840 Legacy Cir., Charlotte, NC (US) 28277

( * ) Notice: Subject to any disclaimer, the term of this patent is extended or adjusted under 35 U.S.C. 154(b) by 0 days.

(21) Appl. No.: 11/045,600

(22) Filed: Jan. 28, 2005

(65) Prior Publication Data

US 2005/0176350 A1 Aug. 11, 2005

Related U.S. Application Data

(60) Provisional application No. 60/542,199, filed on Feb. 5, 2004.

(51) Int. Cl.
*B24B 7/04* (2006.01)

(52) U.S. Cl. ..... 451/11; 451/288; 451/388; 451/443

(58) Field of Classification Search ..... 451/5, 451/11, 285, 286–290, 388, 413, 443, 444
See application file for complete search history.

(56) References Cited

U.S. PATENT DOCUMENTS

| | | | | |
|---|---|---|---|---|
| 4,583,325 | A | 4/1986 | Tabuchi | |
| 4,947,598 | A | 8/1990 | Sekiya | |
| 5,679,060 | A | 10/1997 | Leonard et al. | |
| 5,791,976 | A | 8/1998 | Honda | |
| 5,827,112 | A | 10/1998 | Ball | |
| 6,062,954 | A | 5/2000 | Izumi | |
| 6,159,071 | A * | 12/2000 | Koma et al. | 451/5 |
| 6,168,499 | B1 | 1/2001 | Jang | |
| 6,168,683 | B1 * | 1/2001 | Cesna | 156/345.13 |
| 6,332,833 | B1 | 12/2001 | Ohshima et al. | |
| 6,431,949 | B1 * | 8/2002 | Ishikawa et al. | 451/5 |
| 6,431,964 | B1 | 8/2002 | Ishikawa et al. | |
| 6,443,818 | B1 | 9/2002 | Bent | |
| 6,527,627 | B1 * | 3/2003 | Arai | 451/41 |
| 6,685,542 | B1 * | 2/2004 | Mori et al. | 451/65 |
| 2002/0086623 | A1 | 7/2002 | Togawa et al. | |
| 2002/0160691 | A1 | 10/2002 | Ishikawa et al. | |
| 2003/0232581 | A1 | 12/2003 | Ki | |

OTHER PUBLICATIONS

G&N, Fully Automatic Mater Grinding with the Nanogrinder/4-300, catalog, unknown date, 4 pgs., printed in Germany.
G&N, Fully Automatic Wafer Grinder Multi-Nono/3-300, catalog, unknown date, 4 pgs., printed in Germany.
G&N, Precision. Economy. Reliability. The G&N Machine Program for semiconductor Production and Other Advanced Materials, unknown date, 16 pgs., printed in Germany.

* cited by examiner

*Primary Examiner*—Lee D. Wilson
*Assistant Examiner*—Anthony Ojini
(74) *Attorney, Agent, or Firm*—Adams Evans P.A.

(57) ABSTRACT

A grinder designed to provide an automatic grinding operation for the manufacture of a semiconductor device wafer. The grinder includes a base, a rotatable index table mounted to the base, and a grinding wheel assembly including a grinding wheel for grinding a flat surface on the wafer. The index table includes a wafer holder for receiving and holding the wafer and a dressing element for dressing the grinding wheel. The index table is selectively rotatable between a grinding position where the wafer is ground by the grinding wheel and a dressing position where the grinding wheel is dressed by the dressing element.

20 Claims, 18 Drawing Sheets

SEMICONDUCTOR WAFER GRINDER

This application claims the benefit of Provisional Application No. 60/542,199 filed on Feb. 5, 2004.

TECHNICAL FIELD AND BACKGROUND OF THE INVENTION

This invention relates to a grinding machine and a method for grinding a semiconductor device wafer. The grinding machine is designed to provide an automatic grinding operation for the manufacture of a semiconductor device wafer. More specifically, the grinding machine incorporates several automatic functions to aid in the grinding of a wafer, such as a rotary index table with dressing stations located thereon and an automatic loading and unloading device.

Wafer grinding machines are well-known in the art, however, prior art designs have several disadvantages which the present invention addresses. Typically, grinding machines are not capable of being used in a clean-room environment. This is due to the fact that these machines are too big and contain other integrated features such as wash stations. The present invention addresses this problem by creating a machine with a relatively small footprint that incorporates quick-connect connections for adding other equipment which can be located in another room.

Additionally, prior art machines do not incorporate dressing stations on the rotary index table. Some machines do not have dressing stations at all, but those that do locate the dressing stations adjacent the rotary index table. This results in the grinding spindles being mounted for both rotation in the horizontal plane and linearly in the vertical plane. This can cause alignment problems for the grinding wheels, diminishing the accuracy of the grinding process. This also results in lost time, as the grinding process is completely halted to allow the grinding wheels to rotate to the dressing station and then rotate back into position to continue grinding. The present invention addresses this problem by providing dressing stations located on the rotary index table. This allows the grinding spindles to be fixedly mounted to a linear motion system eliminating the need to rotate the grinding spindle.

SUMMARY OF THE INVENTION

Therefore, it is an object of the invention to provide a wafer grinding machine with a small footprint;

It is another object of the invention to provide a wafer grinding machine with a rotary index table that has at least one dressing station located thereon;

It is another object of the invention to provide a wafer grinding machine that is fully automatic;

It is another object of the invention to provide a wafer grinding machine that has an automatic loading and unloading device;

It is another object of the invention to provide a wafer grinding machine which can be operated in a clean-room environment;

It is another object of the invention to provide a method for grinding a wafer.

These and other objects of the present invention are achieved in the preferred embodiments disclosed below by providing a grinder for grinding the surface of a semiconductor wafer. The grinder includes a base; a rotatable index table mounted to the base and having a wafer holder for receiving and holding a wafer; a grinding wheel assembly mounted to the base and including a grinding wheel for grinding a flat surface on the wafer; and a dressing element positioned on the index table for periodically dressing the grinding wheel. The index table is selectively rotatable between a grinding position where the wafer is ground by the grinding wheel; and a dressing position where the grinding wheel is dressed by the dressing element.

According to another preferred embodiment of the invention, the grinder further includes a wafer handling apparatus mounted to the base for positioning the wafer on and removing the wafer from the wafer holder.

According to another preferred embodiment of the invention, the wafer handling apparatus includes a generally upright shaft protruding through the base and mounted for rotary motion; a laterally-extending arm mounted to an end of the shaft for rotation with the shaft between a loading position and an unloading position; and a holder attached to a free end of the arm for lifting and holding the wafer.

According to another preferred embodiment of the invention, the grinder further includes a loading cassette for storing the wafer before grinding and an unloading cassette for storing the wafer after grinding, the loading and unloading cassettes being carried by the base and positioned on opposite sides of the wafer handling apparatus and configured whereby the wafer handling apparatus accesses the loading cassette for removing a wafer therefrom and placing the wafer on the wafer holder, and for removing the wafer from the wafer holder and accessing and depositing the wafer in the unloading cassette for storage therein.

According to another preferred embodiment of the invention, the loading cassette and unloading cassette are slidably attached to the base and selectively moveable towards and away from the wafer handling apparatus, the loading cassette moving towards the wafer handling apparatus to a loading position for removing a wafer therefrom and away from the wafer handling apparatus to a storage position, and the unloading cassette moving towards the wafer handling apparatus to an unloading position for receiving the wafer therein and away from the wafer handling apparatus to a storage position.

According to another preferred embodiment of the invention, the base comprises a vibration absorbing material for providing enhanced stability and vibration-free operation of the grinder during wafer grinding.

According to another preferred embodiment of the invention, the vibration material includes a polymer for preventing the base from expanding with temperature changes and allowing the base to be anchored to a surface.

According to another preferred embodiment of the invention, the wafer holder is mounted for rotation independent of the index table.

According to another preferred embodiment of the invention, the wafer holder includes a vacuum source for applying a vacuum to the wafer for attaching the wafer to the wafer holder during grinding.

According to another preferred embodiment of the invention, a grinder for grinding the surface of a semiconductor wafer includes a base; a rotatable index table mounted to the base and having a plurality of rotating vacuum chucks, each of the chucks being adapted for receiving and holding a wafer, the chucks being rotatable independent of the index table; a wafer handling apparatus mounted to the base for positioning wafers on and removing wafers from the chucks; first and second grinding wheel assemblies mounted to the base, the first grinding wheel assembly having a first grinding wheel and the second grinding wheel assembly having a second grinding wheel for grinding a flat surface on the wafer; and first and second dressing elements positioned on the index table for periodically dressing the first and second grinding wheels respectively. The index table is selectively rotatable between a grinding position where the wafer ground by one of the grinding wheels; and a dressing position where the first and second grinding wheels are dressed by the first and second dressing elements.

According to another preferred embodiment of the invention, the first grinding wheel is a coarse grinding wheel and the second grinding wheel is a fine grinding wheel.

According to another preferred embodiment of the invention, a method for grinding a semiconductor wafer includes the steps of providing a grinder; grinding a plurality of wafers to a point where the grinding wheel requires dressing; rotating the index table in a first direction to a dressing position where the grinding wheel is dressed by the dressing element; and rotating the index table in a second direction from the dressing position to a grinding position where the wafers are ground by the grinding wheel. The grinder includes a base; a rotatable index table mounted to the base and having a wafer holder for receiving and holding a wafer; a grinding wheel assembly mounted to the base and including a grinding wheel for grinding a flat surface on the wafer; a dressing element positioned on the index table for periodically dressing the grinding wheel; and a wafer handling apparatus mounted to the base for positioning the wafer on and removing the wafer from the wafer holder.

According to another preferred embodiment of the invention, the method further includes a second grinding wheel assembly mounted to the base and including a second grinding wheel.

According to another preferred embodiment of the invention, the method further includes the steps of removing the wafer from a loading cassette using the wafer handling apparatus; positioning the wafer on the wafer holder at a loading position; rotating the index table in the first direction to the grinding position for grinding the wafer; grinding a flat surface on the wafer with the grinding wheel; rotating the index table in the first direction to a second grinding position for grinding the wafer; grinding a flat surface on the wafer with the second grinding wheel; rotating the index table in the second direction to an unloading position so as to expose the wafer; removing the wafer from the wafer holder using the wafer handling apparatus; and placing the wafer into an unloading cassette for storage.

According to another preferred embodiment of the invention, the method further includes the steps of placing a second wafer on a second wafer holder while the wafer is being ground by the grinding wheel; grinding the second wafer with the grinding wheel while the wafer is being ground by the second grinding wheel; placing a third wafer on a third wafer holder while the second wafer is being ground by the grinding wheel and the wafer is being ground by the second grinding wheel; and grinding the third wafer with the grinding wheel and grinding the second wafer with the second grinding wheel while removing the wafer from the wafer holder.

According to another preferred embodiment of the invention, the index table rotates about 60 degrees in the first direction to move from the grinding position to the dressing position; and the index table rotates about 60 degrees in the second direction to move from the dressing position to the grinding position.

According to another preferred embodiment of the invention, the index table rotates about 120 degrees in the first direction from the loading position to the grinding position; the index table rotates about 120 degrees in the first direction from the first grinding position to the second grinding position; and the index table rotates about 240 degrees in the second direction from the second grinding position to the unloading position.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
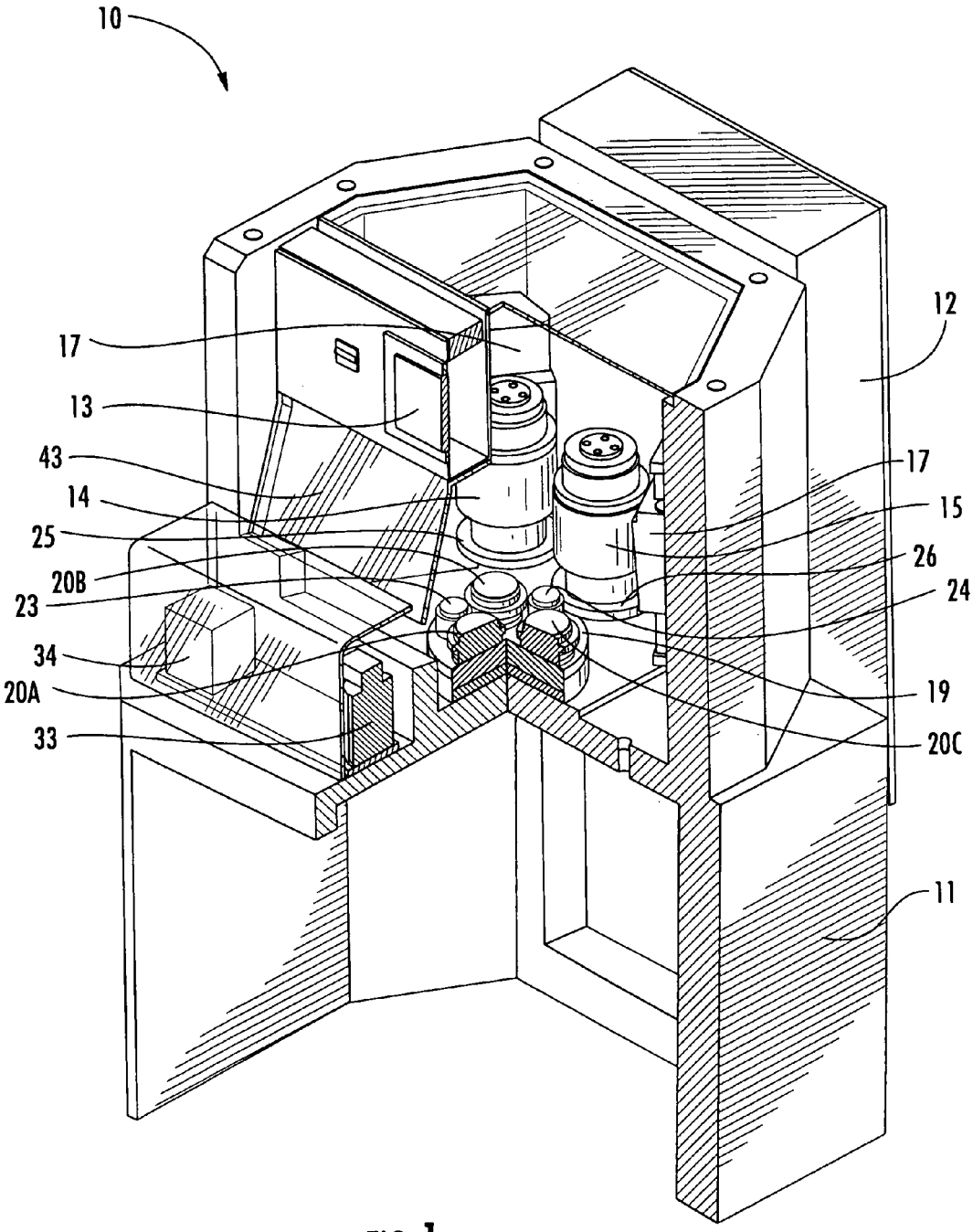
FIG. 1 shows a cut-away of the wafer grinding machine.
Figure 2:
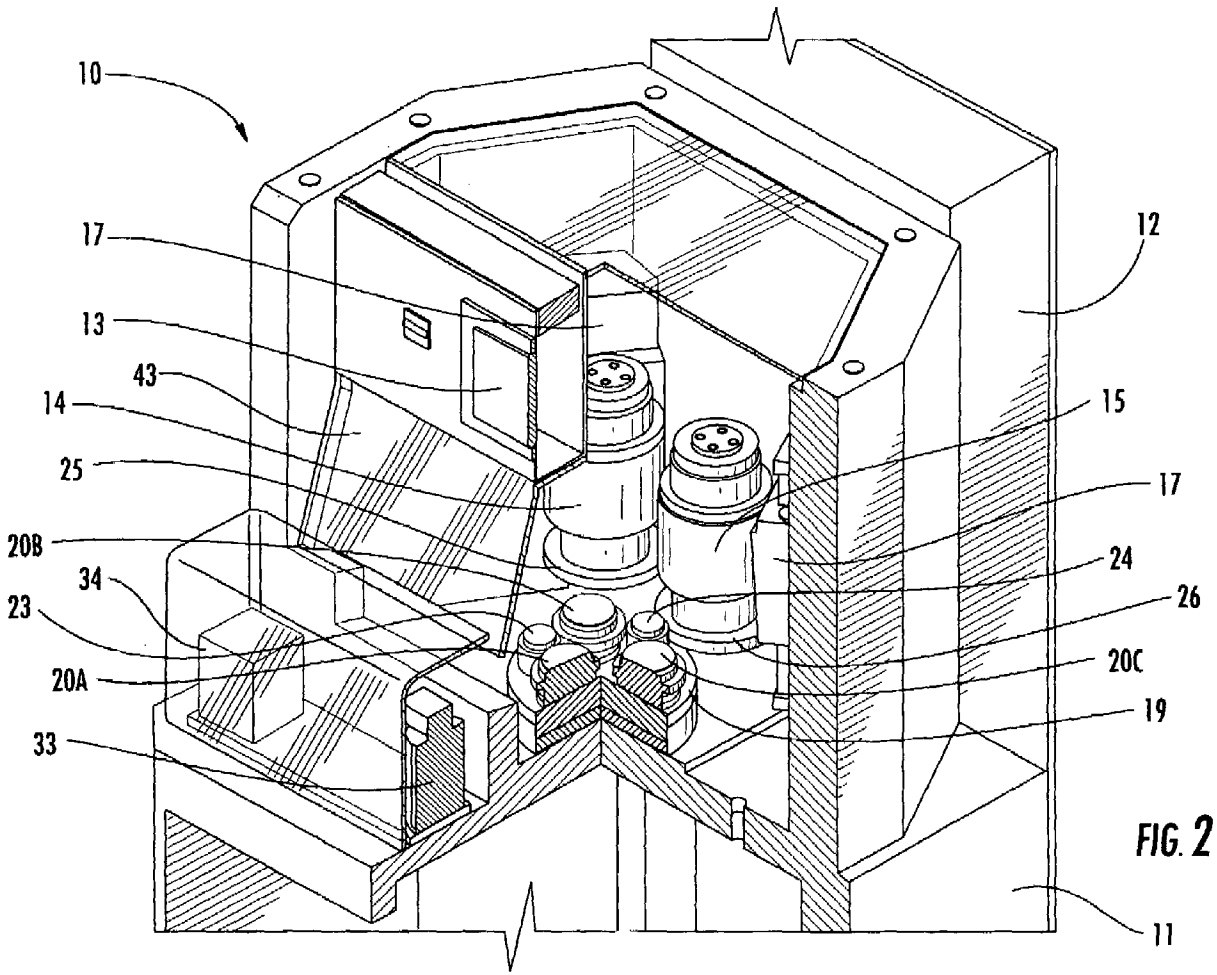
FIG. 2 shows a closer view of the cut-away of the wafer grinder.
Figure 3:
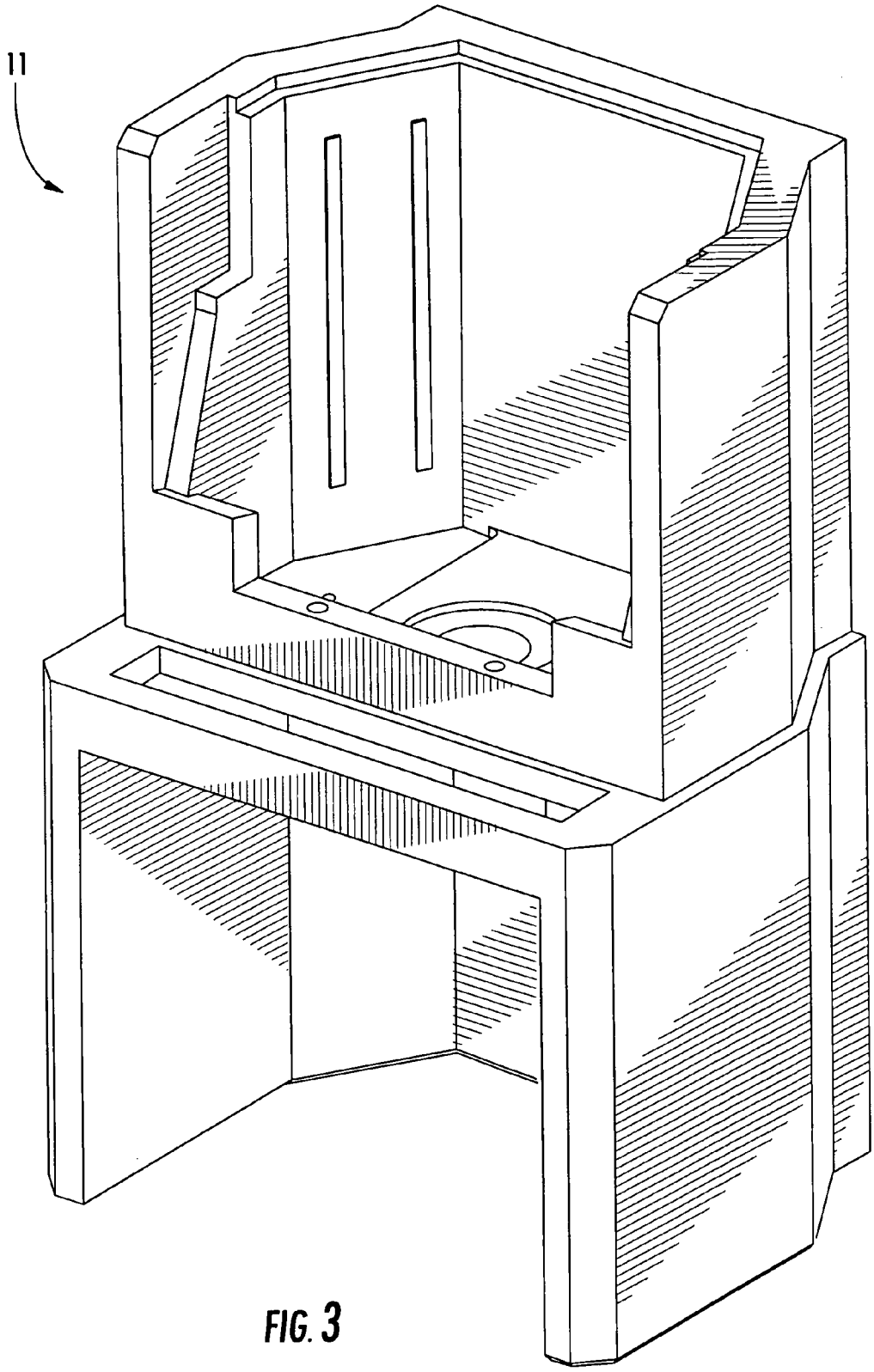
FIG. 3 shows a perspective view of the one piece polymer base.

Referring to FIGS. 1, 2 and 3, the present invention generally comprises a grinding machine 10. As illustrated, the machine 10 is relatively compact, for example, its footprint is less than 1 square meter. The grinding machine 10 is supported by a one-piece, high-mass polymer concrete base 11 which provides structural integrity to the grinding machine 10. The use of a one-piece polymer base 11 is very helpful for absorbing all critical vibrations. This is an important consideration to the grinding process, as vibrations can cause the wafer to be ground improperly resulting in a defective wafer. The base material does not expand with temperature changes, thus allowing the grinding machine 10 to be fixed to a surface with cast-in anchors at fixed mounting points without the concern of the grinding machine 10 being affected by movement in the base 11.

A control cabinet 12 is located in the back of the grinding machine 10. The cabinet 12 houses all electrical and electronic components. The programs used to operate the machine are accessed via menu screens on a color touch panel 13 located in front of the grinding machine 10.

The grinding machine 10 also includes quick-connect couplings (not shown) to allow connection of independent platforms such as a vacuum pump, air valves and regulators, and water valves and regulators to the grinding machine 10. This design permits the positioning of these components outside of a clean-room while allowing the grinding machine 10 to operate within the clean-room.

The grinding machine 10 includes two maintenance-free motorized precision grinding spindles 14 and 15, one for rough grinding and one for fine grinding, mounted 120 degrees apart which operate between 800–4,000 rpm. The spindles 14 and 15 are mounted to rolling element linear motion systems, such as a z-axis ball rail slide 17 for accuracy and rigidity. An engraved glass-scale measuring system (not shown), such as those produced by Heidenheim is used to control the down-feed of the motorized grinding spindles 14 and 15 in 0.1 micron increments.

Figure 4:
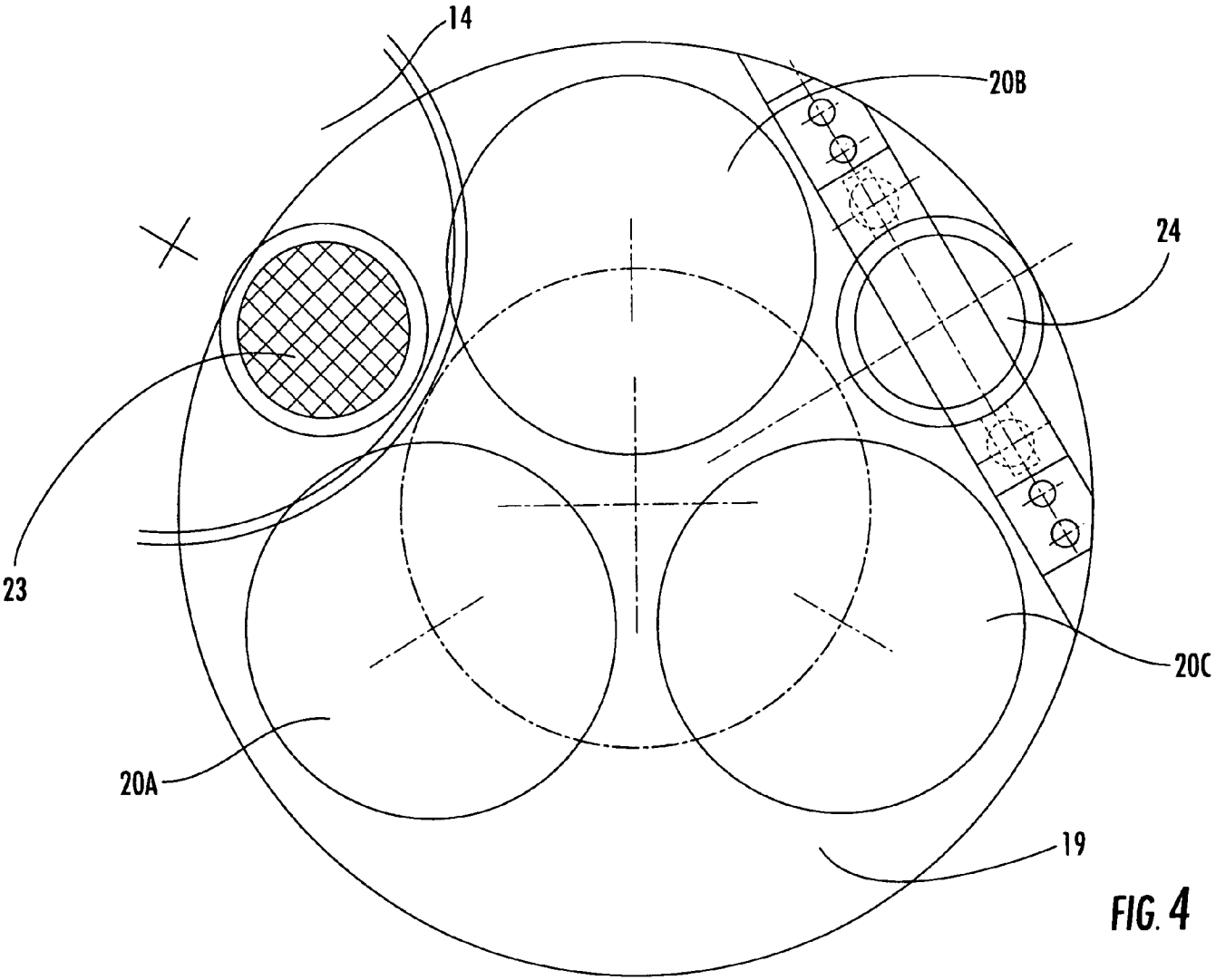
FIG. 4 shows a schematic of the index table with vacuum chucks and dressing stations.
Figure 5:
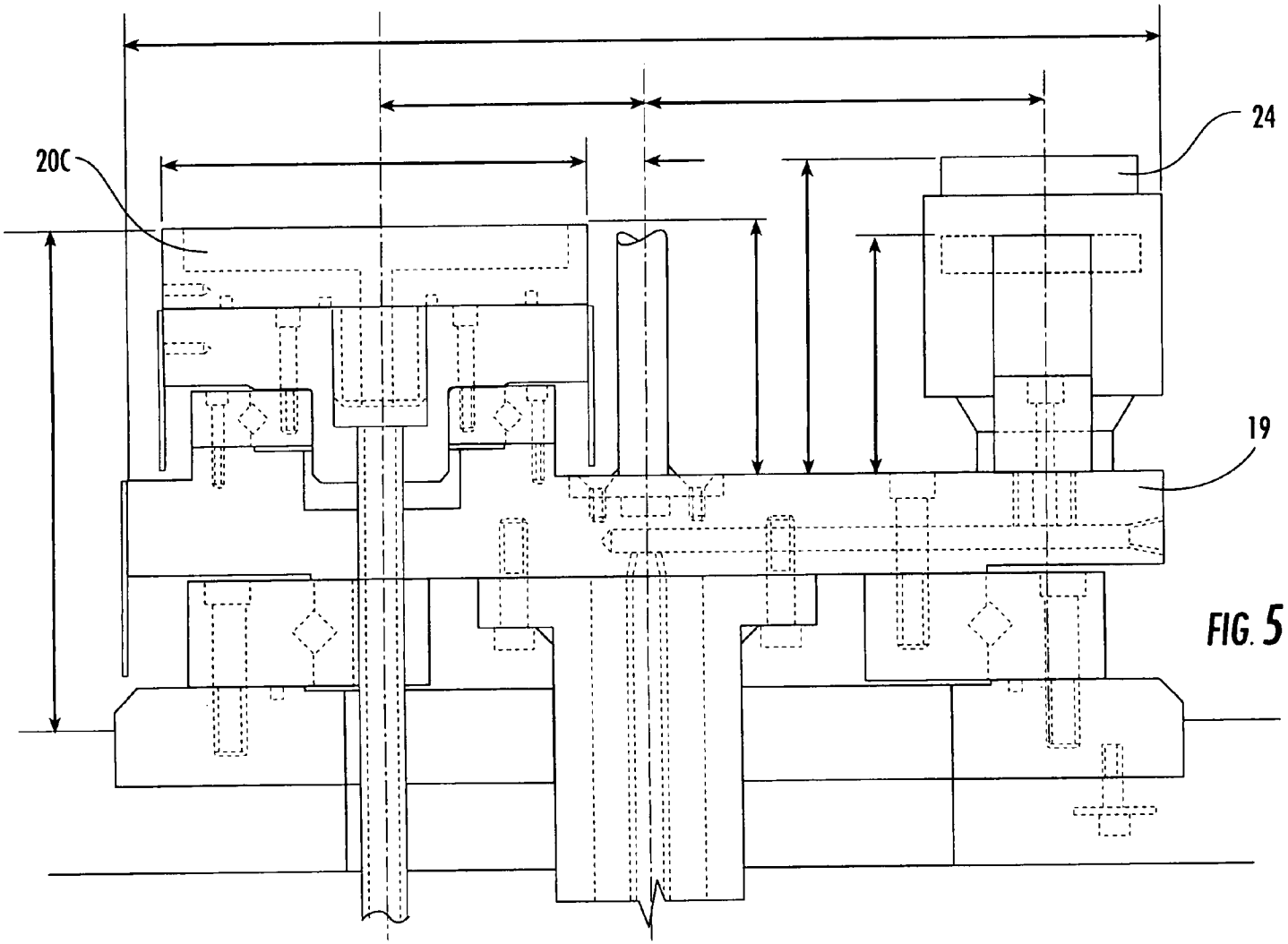
FIG. 5 shows a cross section of the index table.
Figure 6:
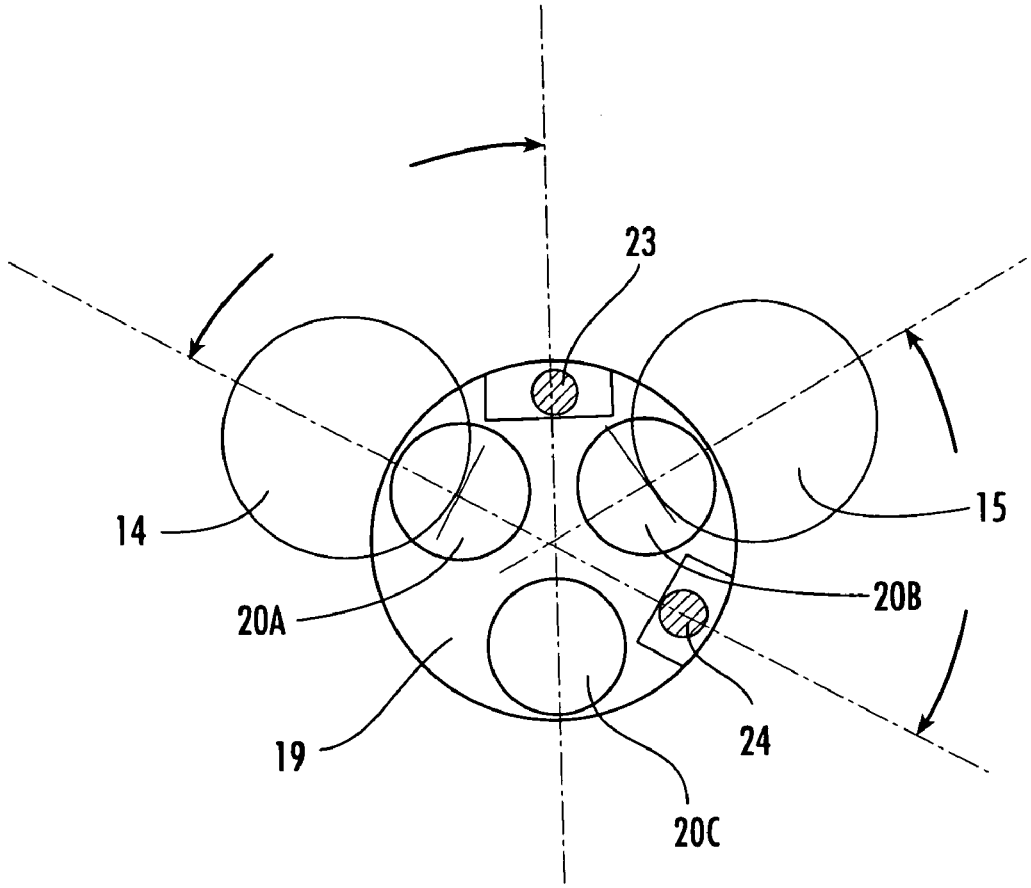
FIG. 6 shows a schematic of the grinding and dressing stations in relation to the grinding wheels.
Figure 7:
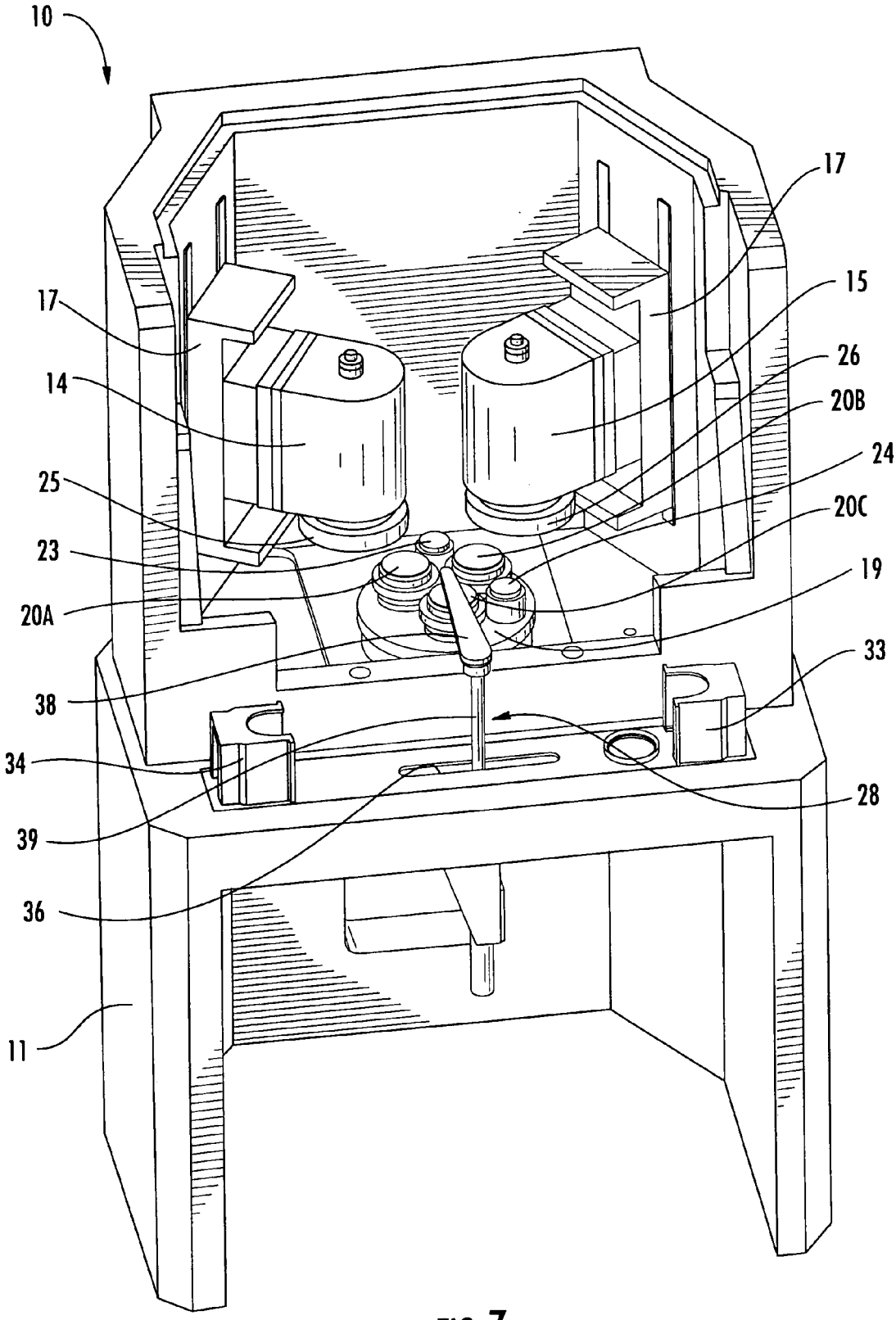
FIG. 7 shows a perspective view of a first embodiment of the wafer grinding machine.
Figure 8:
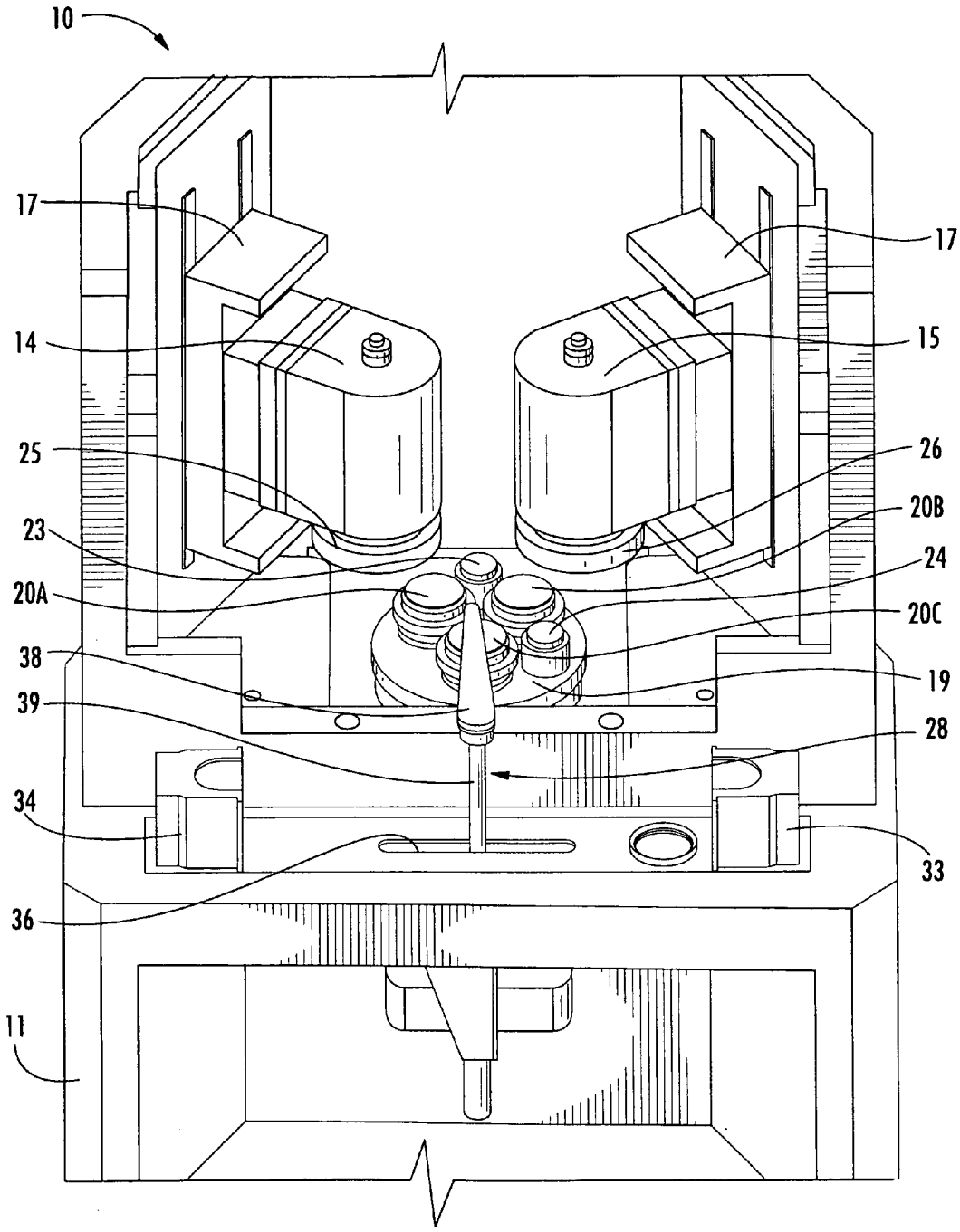
FIG. 8 shows a closer view of a first embodiment of the wafer grinding machine.
Figure 9:
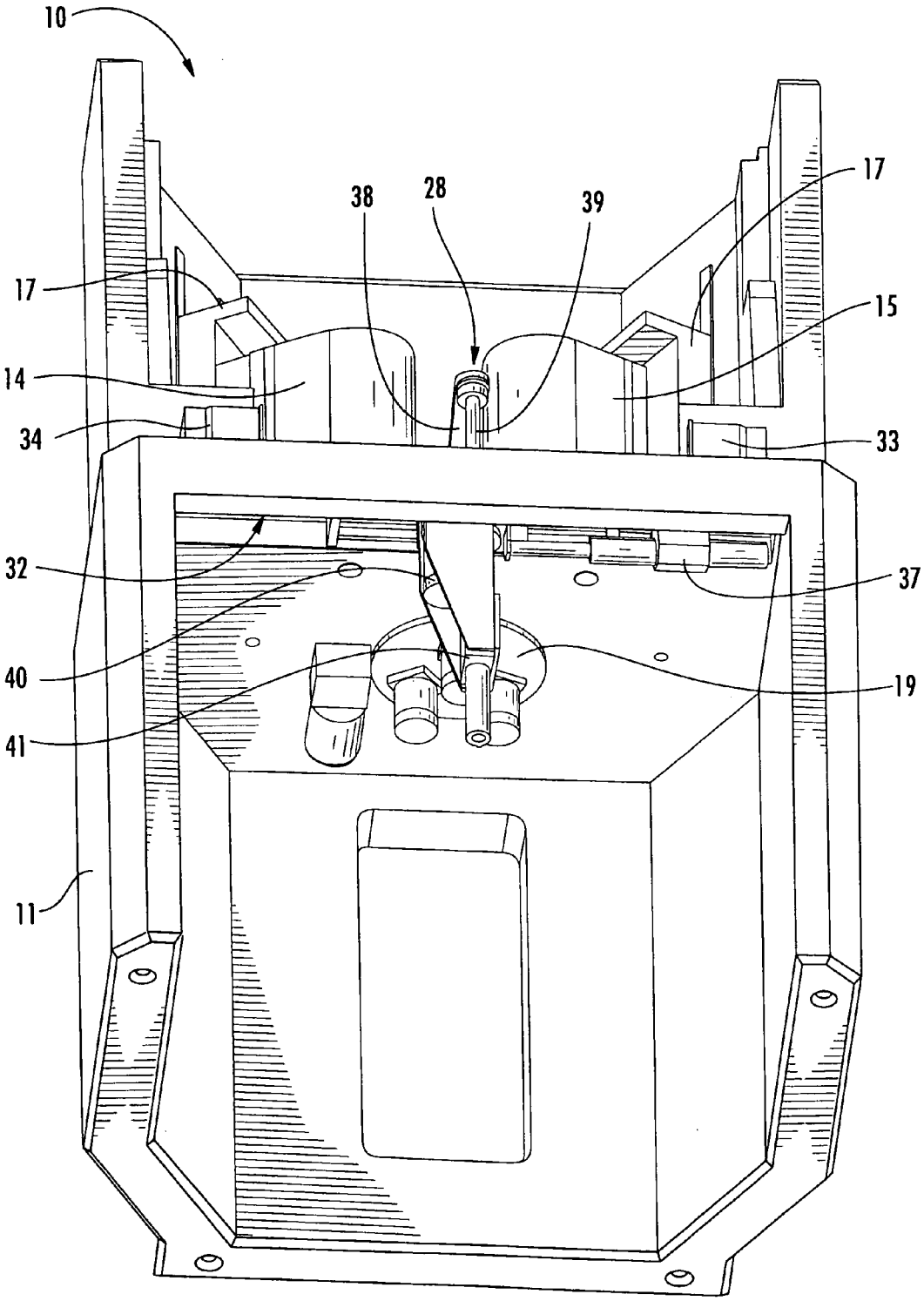
FIG. 9 shows a bottom view of the first embodiment of the wafer grinding machine.

Referring to FIGS. 4, 5, and 6, the grinding machine 10 includes a rotary index table 19 which supports three wafer holders, such as rotating vacuum chucks 20A–20C. The index table 19 is mounted for rotary movement using large diameter thrust and radial bearings 21 and 22 to maintain accuracy during rotation. The three rotating vacuum chucks 20A–20C have independent speed control and are mounted 120 degrees apart on the index table 19. The index table 19 design allows wafers to be ground to a predetermined thickness starting with a coarse 25 and ending with a fine diamond grinding wheel 26.

The rotary index table 19 also includes two dressing stations 23 and 24 for dressing the grinding wheels 25 and 26 during operation. The first dressing station 23 is designed for dressing the coarse grinding wheel 25 and the second dressing station 24 is designed for the fine grinding wheel 26. The dressing stations 23 and 24 are positioned on the rotary index table 19 60 degrees between the vacuum chucks 20A–20C, and 120 degrees apart to allow dressing of the coarse grinding and fine grinding wheels 25 and 26 at the same time.

The wheel dressing procedure is started by a signal from the controller. The two grinding spindles 14 and 15 are raised to clear the working area to allow the index table 19 to rotate. Compressed air is used to actuate the two dressing units 23 and 24 mounted 60 degrees between the vacuum chucks 20A–20C. The index table 19 begins a 60 degree oscillating movement and one grinding wheel after the other is lowered on the corresponding dressing stone. This process is fully automated.

Referring to FIGS. 7, 8, 9, 10, 11, 12, and 13, a robotic arm type wafer handler 28 is used to bring fresh wafers to the index table 19 and remove the finished wafers from the index table 19 during the grinding process. In a first embodiment of the invention, the wafer handler 28 is mounted for both linear and rotary movement. In this embodiment, the wafer handler is mounted to a base 29 which is slidably mounted to two rails 30 and 31 for linear motion in the horizontal plane. The two rails 30 and 31 are mounted inside of a channel 32 which has a wafer cassette 33 and 34 fixedly mounted on each end and a slot 36 cut in the center to allow linear movement of the wafer handler 28. A motor 37 is connected to the base 29 and provides the linear motion necessary for the base 29 to slide along the two rails 30 and 31. The motor 37 is capable of moving the base 29 in a back and forth motion along the two rails 30 and 31 allowing the wafer handler 28 to slide from one end of the channel 32 to the other end within the slot 36.

The wafer handler has a horizontal arm 38 mounted to a vertical shaft 39. The vertical shaft 39 protrudes through the base 29 and is mounted for rotary motion. A step motor 40 is connected to the vertical shaft 39 and is used to move the arm 38 180 degrees measured from a right end of the channel 32 to a left end of the channel 32. Another linear motor 41 is connected to the vertical shaft 39 to move the shaft 39 linearly in the vertical plane. The arm 38 is equipped with a suction cup 42 for lifting semiconductor devices and proximity sensors for positioning the semiconductor devices to be ground. The wafer handler 28 is fully automated and the operator only has to exchange the cassettes.

Figure 14:
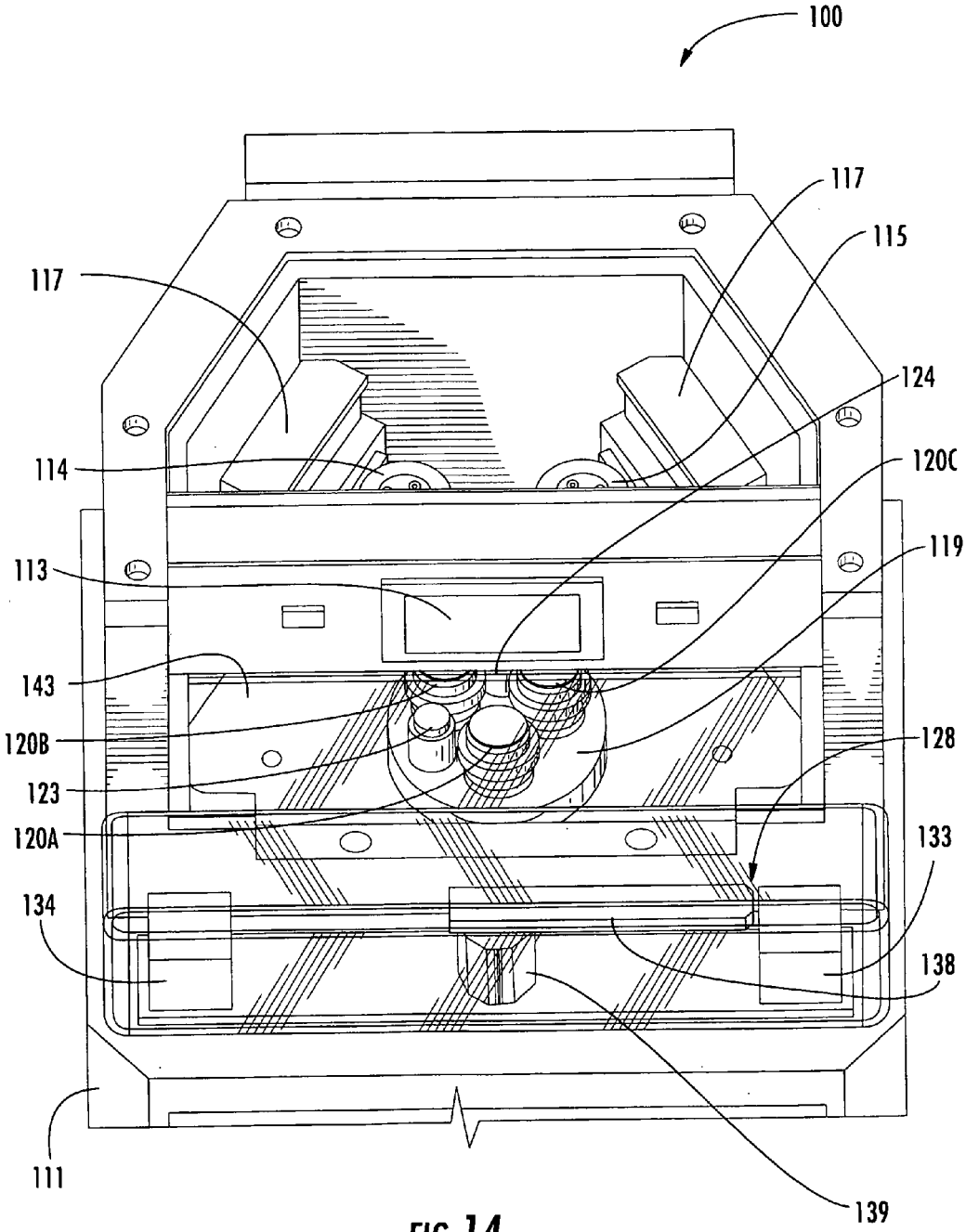
FIG. 14 shows the wafer grinder of the second embodiment of the invention.
Figure 15:
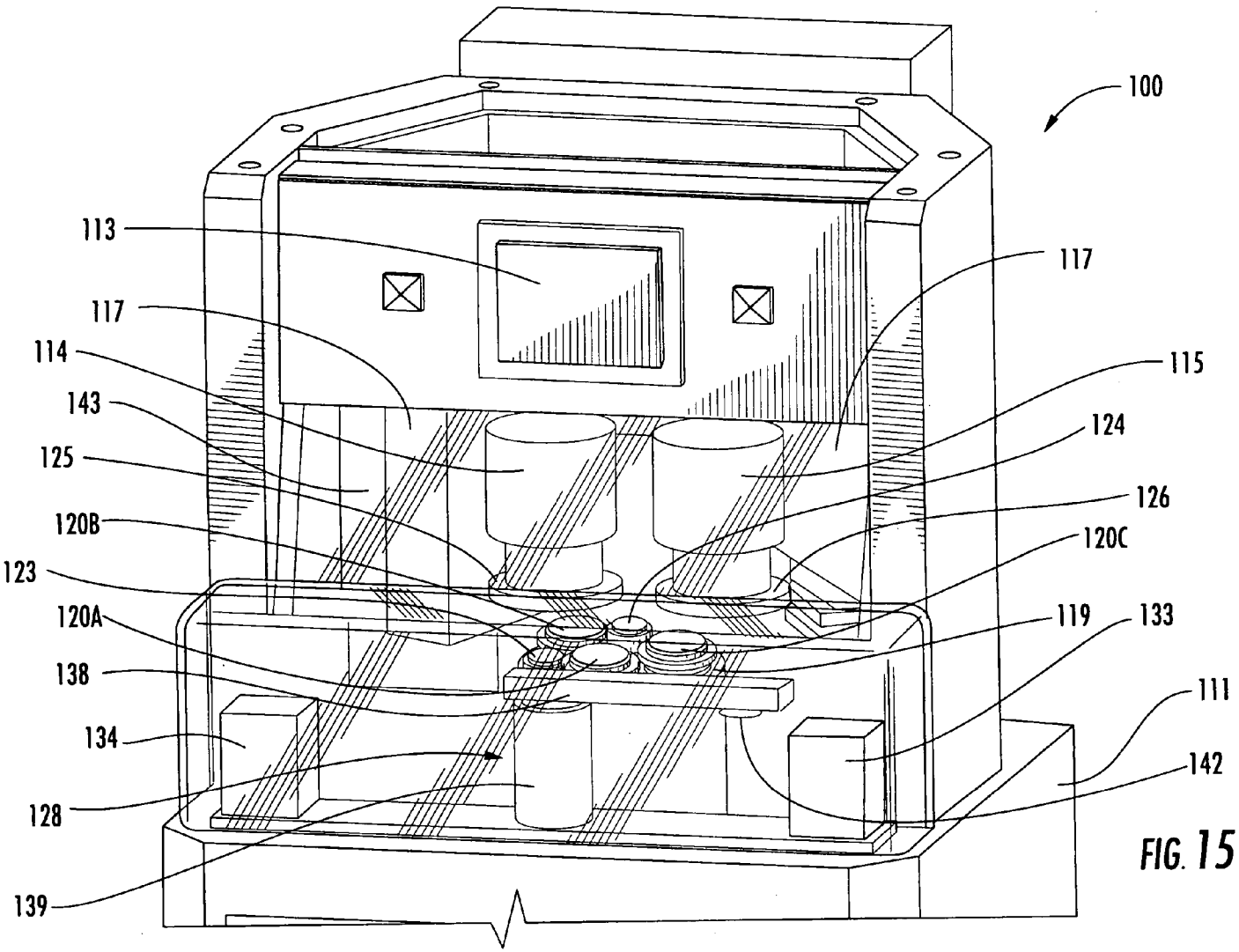
FIG. 15 shows the wafer grinder of the second embodiment of the invention.
Figure 16:
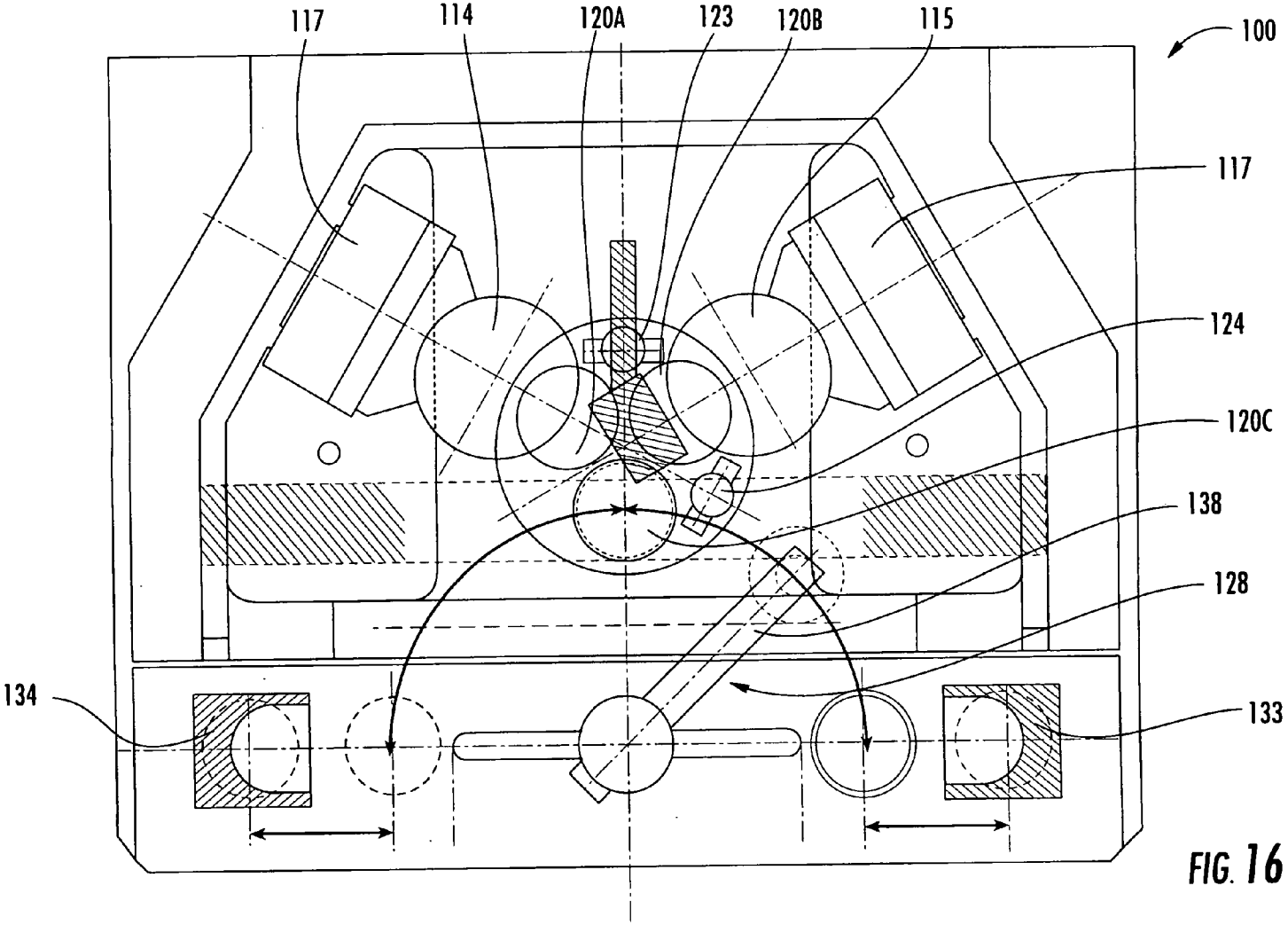
FIG. 16 shows a plan view of the second embodiment of the invention.
Figure 17C:
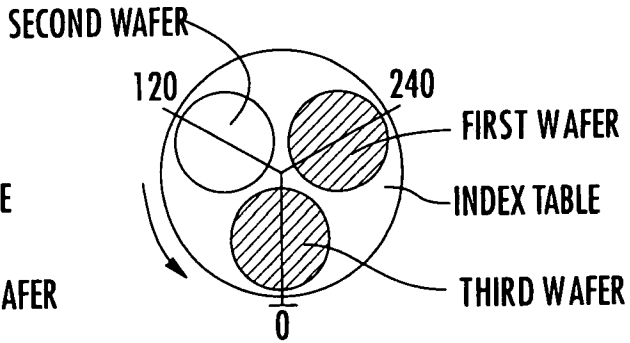
FIG. 17 shows the process of operation for the wafer grinder.
Figure 17B:
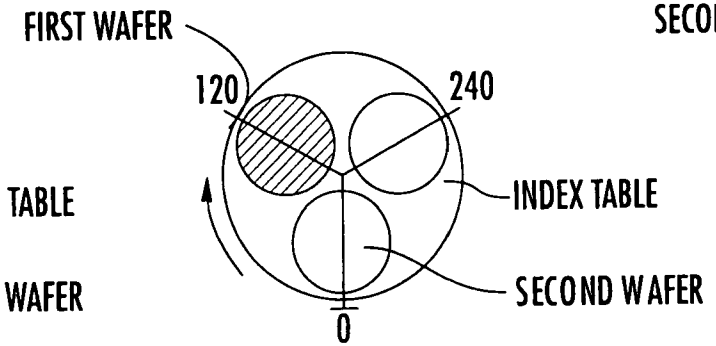
Figure 17A:
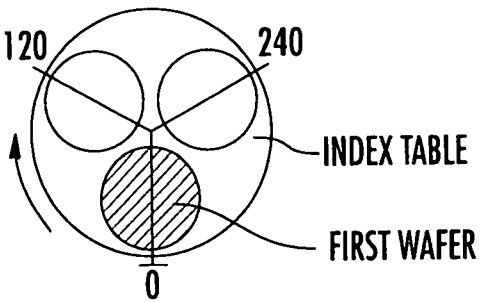
Figure 17D:
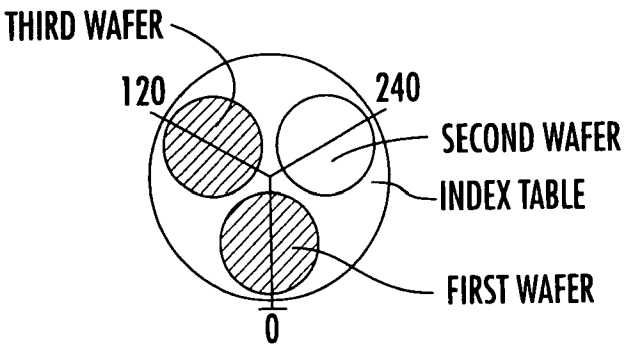
Figure 18:
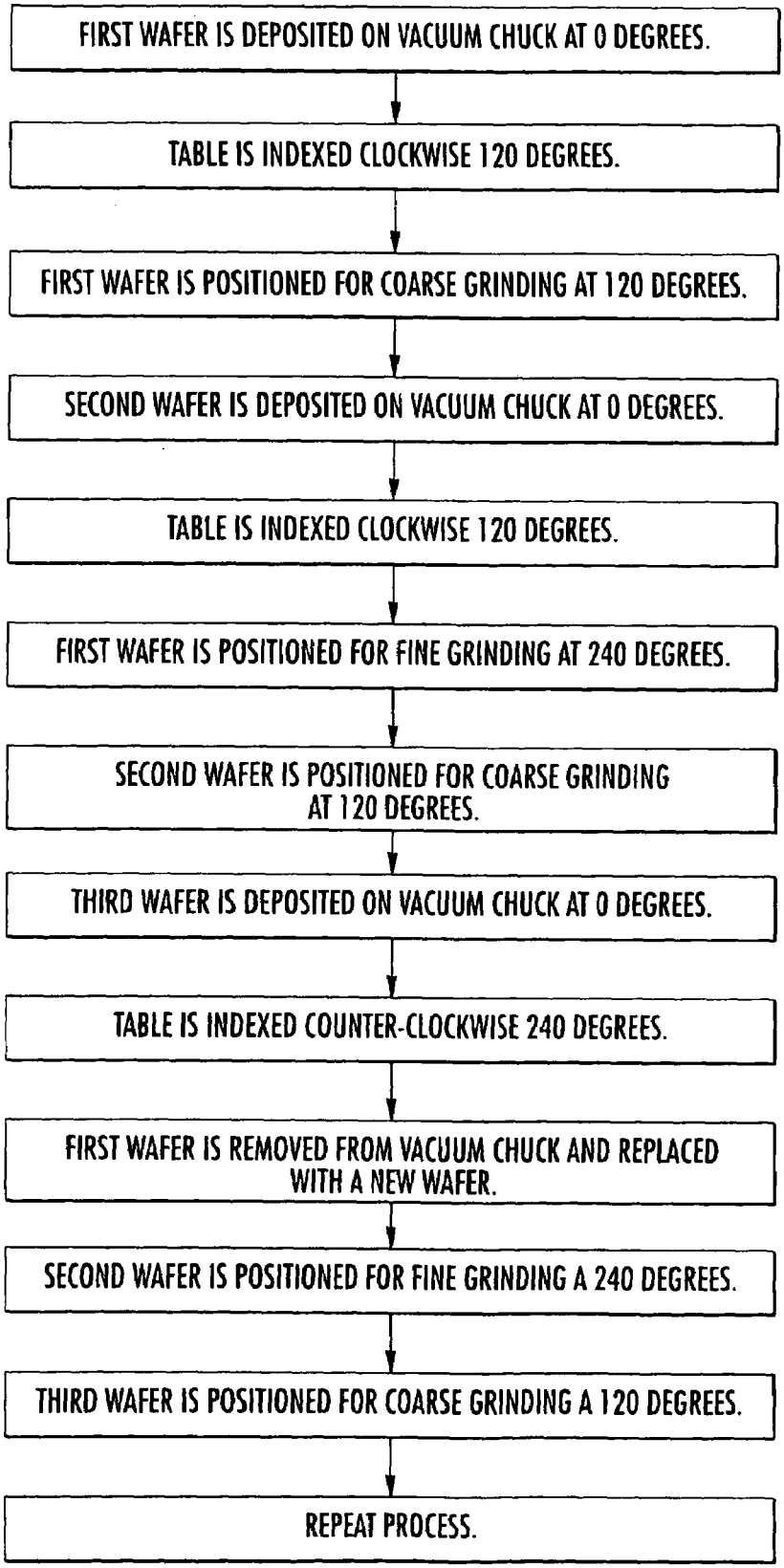
FIG. 18 is a flow diagram of the process of FIG. 17.

Referring to FIGS. 14, 15, and 16, in a second embodiment of the invention, the robotic type wafer handler 128 is mounted for rotary motion only. In this embodiment, the wafer cassettes 133 and 134 are mounted for linear motion instead of the wafer handler 128. As above, the wafer handler 128 has a horizontal arm 138 mounted to a vertical shaft 139 which is rotated 180 degrees by a step motor 140. The arm 138 is equipped with a suction cup 142 and proximity sensors and is fully automated.

A commercially available wafer thickness measuring device, such as those produced by SigmaTech is used to measure the thickness of the wafer during the grinding process. The device uses an airflow sensor positioned above the target and allows for an exact in-process measurement of the wafer thickness in a wet environment.

Figure 10:
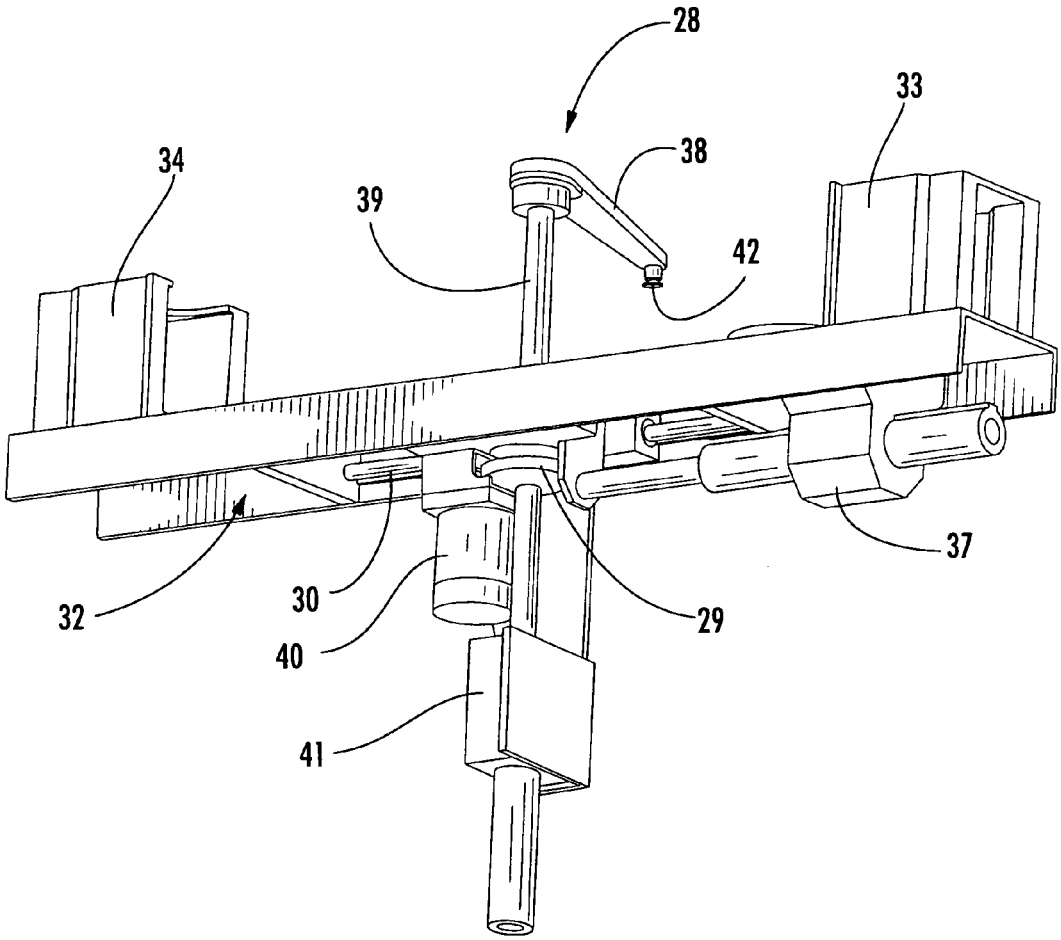
FIG. 10 shows the wafer handler of the first embodiment of the invention.
Figure 11:
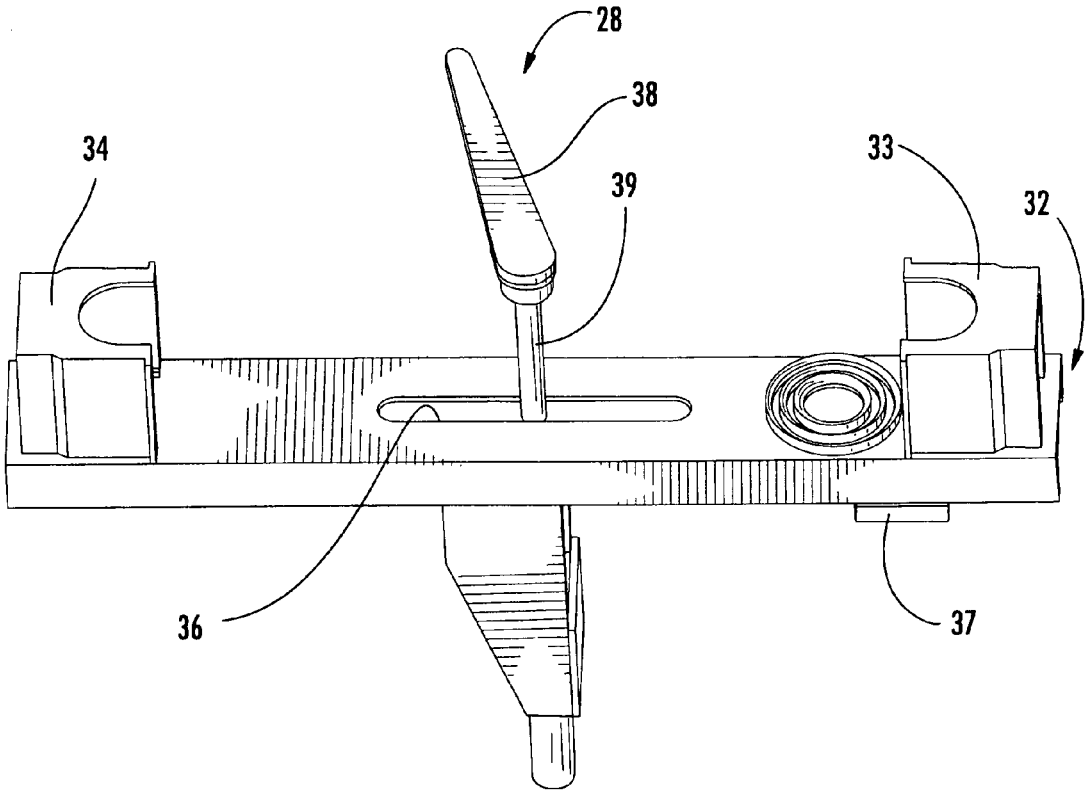
FIG. 11 shows the wafer handler of the first embodiment of the invention.
Figure 12:
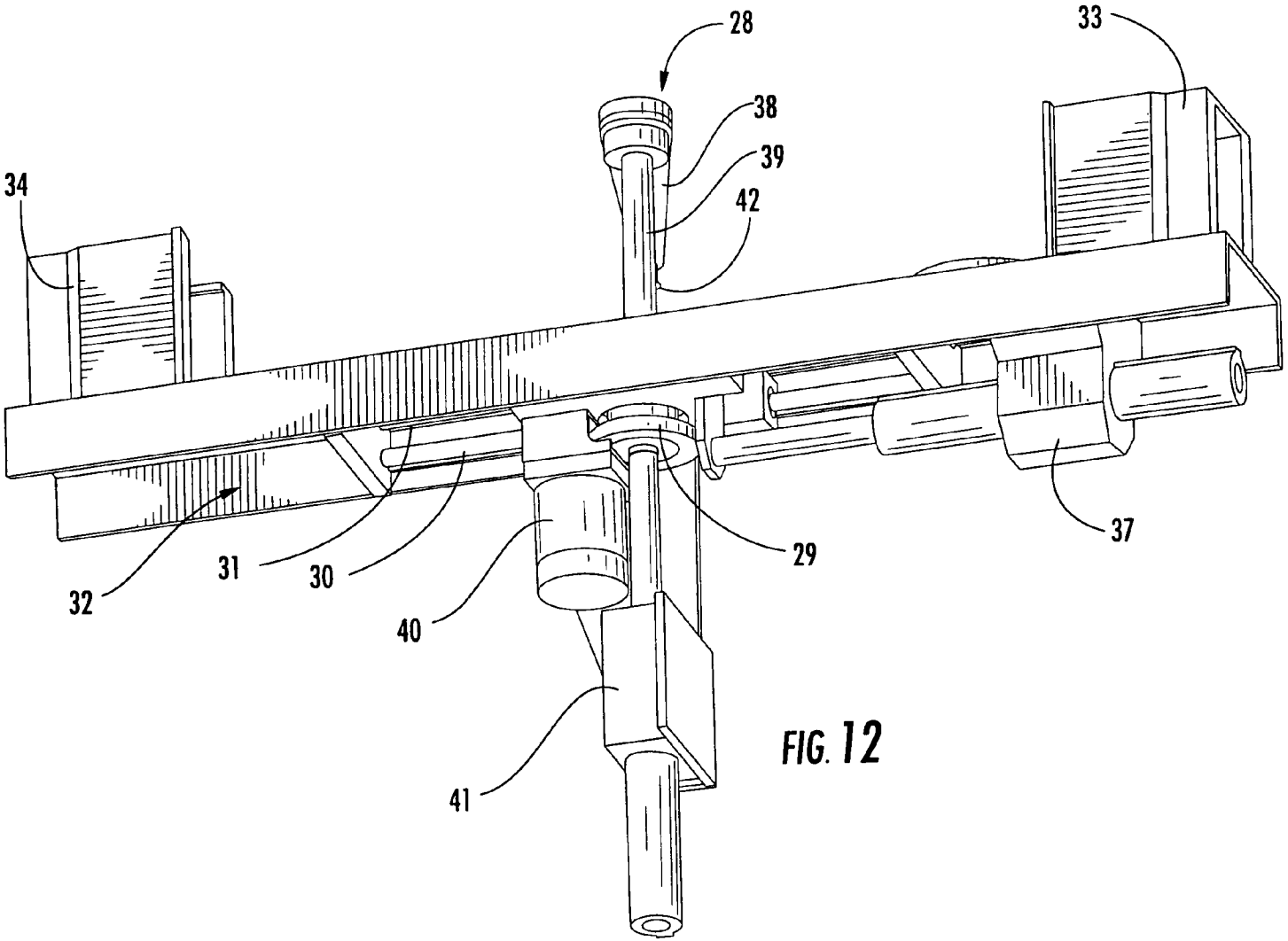
FIG. 12 shows the wafer handler of the first embodiment of the invention.

Referring to FIGS. 1, 13, 16, and 17, the process for grinding a wafer includes several steps. The process starts with wafer handling. A grinding chamber gate 43 is opened to allow the arm 38 to position a wafer on a vacuum chuck 20A. Referring specifically to FIG. 10, in the first embodiment of the invention, the wafer handler 28 moves linearly in the horizontal direction towards the wafer loading cassette 33 located on a right hand side of the grinding machine 10. The arm 38 is then rotated to position the arm 38 in line with the loading cassette 33 to allow the arm 38 to remove a wafer from the loading cassette 33. The arm 38 uses the suction cup 42 located on the free end of the arm 38 to remove the wafer from the loading cassette 33. The wafer handler 28 is then moved linearly to a center point between the loading cassette 33 located on the right hand side of the grinding machine 10 and the unloading cassette 34 located on the left hand side of the grinding machine. The arm 38 then rotates 90 degrees counter-clockwise and positions a first wafer onto a first vacuum chuck 20A.

Referring specifically to FIG. 16, in the second embodiment of the invention, the arm 138 is rotated to position the arm in line with the loading cassette 133 to allow the arm 138 to remove a wafer from the loading cassette 133. The loading cassette 133 moves linearly towards the arm 138 to allow the arm 138 to remove a wafer from the loading cassette 133. The arm 138 uses the suction cup 142 located on the free end of the arm 138 to remove the wafer from the loading cassette 133. The arm 138 then rotates 90 degrees counter-clockwise and positions a first wafer onto a first vacuum chuck 120A.

Referring specifically to FIG. 17, the first vacuum chuck 20A is positioned on the index table 19 at 0 degrees, which is the centerline for the loading/unloading position. With the wafer loaded onto the first vacuum chuck 20A, the index table 19 is indexed 120 degrees clockwise. The first wafer is now in position for coarse grinding (120 degrees). A second wafer is removed from the loading cassette 33 and positioned by the arm 38 onto a second vacuum chuck 20B now located at 0 degrees. The index table 19 is again indexed 120 degrees clockwise. The first wafer is now in position for fine grinding (240 degrees) and the second wafer is in position for coarse grinding (120 degrees). A third wafer is removed from the loading cassette 33 and positioned by the arm 38 onto a third vacuum chuck 20C now located at 0 degrees. The index table is indexed 240 degrees counter-clockwise. The first wafer is now at 0 degrees, the second wafer is now at 240 degrees, and the third wafer is at 120 degrees.

Figure 13:
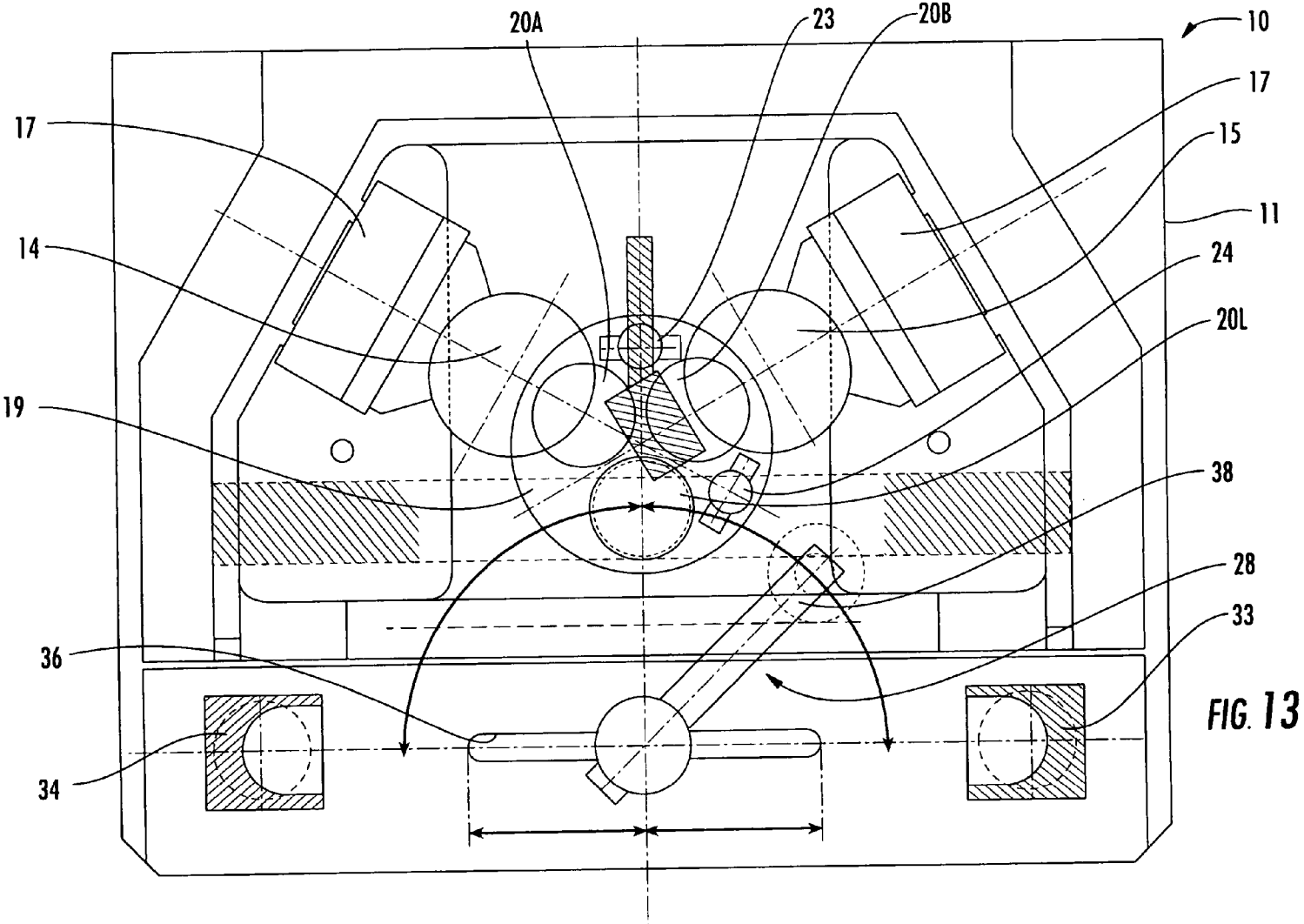
FIG. 13 shows a plan view of the first embodiment of the invention.

The first wafer is now removed from the first vacuum chuck 20A by the arm 38 and placed in an unloading cassette 34. Referring specifically to FIG. 13, in the first embodiment of the invention, the arm 38 removes the first wafer from the vacuum chuck 20A using the suction cup 42 at the free end of the arm 38. The arm 38 rotates 90 degrees counter-clockwise and the wafer handler 28 moves linearly towards the unloading cassette 34 located on the left hand side of the grinding machine 10. The arm 38 then deposits the finished wafer into the unloading cassette 34.

Referring specifically to FIG. 16, in the second embodiment of the invention, the arm 138 removes the first wafer from the vacuum chuck 120A using the suction cup 142 at the free end of the arm 138. The arm 138 rotates 90 degrees counter-clockwise and the unloading cassette 134 moves linearly towards the wafer handler 128. The arm 138 then deposits the finished wafer into the unloading cassette 134. At this point, the second wafer is now in position for fine grinding and the third wafer is in position for coarse grinding. This process is then repeated.

A semiconductor wafer grinder is described above. Various details of the invention may be changed without departing from its scope. Furthermore, the foregoing description of the preferred embodiments of the invention and the best mode for practicing the invention are provided for the purpose of illustration only and not for the purpose of limitation, the invention being identified in the claims.

I claim:

1. A grinder for grinding the surface of a semiconductor wafer, comprising:

(a) a base;

(b) a rotatable index table mounted to the base and having a wafer holder for receiving and holding a wafer;

(c) a grinding wheel assembly mounted to the base and including a grinding wheel for grinding a flat surface on the wafer;

(d) a dressing element positioned on the index table for periodically dressing the grinding wheel;

(e) the index table being selectively rotatable between:

(i) a grinding position where the wafer is ground by the grinding wheel; and (ii) a dressing position where the grinding wheel is dressed by the dressing element.

2. The grinder according to claim 1, and further comprising a wafer handling apparatus mounted to the base for positioning the wafer on and removing the wafer from the wafer holder.

3. The grinder according to claim 2, wherein the wafer handling apparatus comprises:

(a) a generally upright shaft protruding through the base and mounted for rotary motion;

(b) a laterally-extending arm mounted to an end of the shaft for rotation with the shaft between a loading position and an unloading position; and (c) a holder attached to a free end of the arm for lifting and holding the wafer.

4. The grinder according to claim 2, and further including a loading cassette for storing the wafer before grinding and an unloading cassette for storing the wafer after grinding, the loading and unloading cassettes being carried by the base and positioned on opposite sides of the wafer handling apparatus and configured whereby the wafer handling apparatus accesses the loading cassette for removing a wafer therefrom and placing the wafer on the wafer holder, and for removing the wafer from the wafer holder and accessing and depositing the wafer in the unloading cassette for storage therein.

5. The grinder according to claim 4, wherein the loading cassette and unloading cassette are slidably attached to the base and selectively moveable towards and away from the wafer handling apparatus, the loading cassette moving towards the wafer handling apparatus to a loading position for removing a wafer therefrom and away from the wafer handling apparatus to a storage position, and the unloading cassette moving towards the wafer handling apparatus to an unloading position for receiving the wafer therein and away from the wafer handling apparatus to a storage position.

6. The grinder according to claim 1, wherein the base comprises a vibration absorbing material for providing enhanced stability and vibration-free operation of the grinder during wafer grinding.

7. The grinder according to claim 6, wherein the vibration material includes a polymer for preventing the base from expanding with temperature changes and allowing the base to be anchored to a surface.

8. The grinder according to claim 1, wherein the wafer holder is mounted for rotation independent of the index table.

9. The grinder according to claim 1, wherein the wafer holder includes a vacuum source for applying a vacuum to the wafer for attaching the wafer to the wafer holder during grinding.

10. A grinder for grinding the surface of a semiconductor wafer, comprising:

(a) a base;

(b) a rotatable index table mounted to the base and having a plurality of rotating vacuum chucks, each of the chucks being adapted for receiving and holding a wafer, the chucks being rotatable independent of the index table;

(c) a wafer handling apparatus mounted to the base for positioning wafers on and removing wafers from the chucks;

(d) first and second grinding wheel assemblies mounted to the base, the first grinding wheel assembly having a first grinding wheel and the second grinding wheel assembly having a second grinding wheel for grinding a flat surface on the wafer;

(e) first and second dressing elements positioned on the index table for periodically dressing the first and second grinding wheels respectively;

(f) the index table being selectively rotatable between:

(i) a grinding position where the wafer ground by one of the grinding wheels; and (ii) a dressing position where the first and second grinding wheels are dressed by the first and second dressing elements.

11. The grinder according to claim 10, wherein the wafer handling apparatus comprises:

(a) a generally upright shaft protruding through the base and mounted for rotary motion;

(b) a laterally-extending arm mounted to an end of the shaft for rotation with the shaft between a loading position and an unloading position; and (c) a holder attached to a free end of the arm for lifting and holding the wafer.

12. The grinder according to claim 11, and further including a loading cassette for storing the wafer before grinding and an unloading cassette for storing the wafer after grinding, the cassettes being carried by the base and positioned on opposite sides of the wafer handling apparatus so that the wafer handling apparatus and configured whereby the wafer handling apparatus accesses the loading cassette for removing a wafer therefrom and placing the wafer on the wafer holder, and for removing the wafer from the wafer holder and accessing and depositing the wafer in the unloading cassette for storage therein.

13. The grinder according to claim 12, wherein the loading cassette and unloading cassette are slidably attached to the base, the cassettes being selectively moveable towards and away from the wafer handling apparatus, the loading cassette moving towards the wafer handling apparatus to a loading position for removing a wafer therefrom and away from the wafer handling apparatus to a storage position, and the unloading cassette moving towards the wafer handling apparatus to an unloading position for receiving the wafer therein and away from the wafer handling apparatus to a storage position.

14. The grinder according to claim 10, wherein the first grinding wheel is a coarse grinding wheel and the second grinding wheel is a fine grinding wheel.

15. A method for grinding a semiconductor wafer, comprising the steps of:

(a) providing a grinder, comprising:

(i) a base;

(ii) a rotatable index table mounted to the base and having a wafer holder for receiving and holding a wafer;

(iii) a grinding wheel assembly mounted to the base and including a grinding wheel for grinding a flat surface on the wafer;

(iv) a dressing element positioned on the index table for periodically dressing the grinding wheel;

(v) a wafer handling apparatus mounted to the base for positioning the wafer on and removing the wafer from the wafer holder; and (b) grinding a succession of wafers to a point where the grinding wheel requires dressing;

(c) rotating the index table to a dressing position where the grinding wheel is dressed by the dressing element; and (d) rotating the index table from the dressing position to a grinding position where the wafers are ground by the grinding wheel.

16. The method according to claim 15, and further including a second grinding wheel assembly mounted to the base and including a second grinding wheel.

17. The method according to claim 16, and further comprising the steps of:

(a) removing the wafer from a loading cassette using the wafer handling apparatus;

(b) positioning the wafer on the wafer holder at a loading position;

(c) rotating the index table to the grinding position for grinding the wafer;

(e) grinding a flat surface on the wafer with the grinding wheel;

(f) rotating the index table to a second grinding position for grinding the wafer;

(g) grinding a flat surface on the wafer with the second grinding wheel;

(h) rotating the index table to an unloading position so as to expose the wafer;

(i) removing the wafer from the wafer holder using the wafer handling apparatus; and (j) placing the wafer into an unloading cassette for storage.

18. The method according to claim 17, and further comprising the steps of:

(a) placing a second wafer on a second wafer holder while the wafer is being ground by the grinding wheel;

(b) grinding the second wafer with the grinding wheel while the wafer is being ground by the second grinding wheel;

(c) placing a third wafer on a third wafer holder while the second wafer is being ground by the grinding wheel and the wafer is being ground by the second grinding wheel; and (d) grinding the third wafer with the grinding wheel and grinding the second wafer with the second grinding wheel while removing the wafer from the wafer holder.

19. The method according to claim 17, wherein:

(a) the index table rotates about 120 degrees in a first direction from the loading position to the grinding position;

(b) the index table rotates about 120 degrees in the first direction from the first grinding position to the second grinding position; and (c) the index table rotates about 240 degrees in a second direction from the second grinding position to the unloading position.

20. The method according to claim 15, wherein:

(a) the index table rotates about 60 degrees in a first direction to move from the grinding position to the dressing position; and (b) the index table rotates about 60 degrees in a second direction to move from the dressing position to the grinding position.

* * * * *